US007473015B1

(12) United States Patent
Chen

(10) Patent No.: US 7,473,015 B1
(45) Date of Patent: Jan. 6, 2009

(54) COMBINATION LAMPSHADE

(76) Inventor: Wen-Chih Chen, P.O. Box No. 2-53, Linkou, Taipei County 244 (TW)

( * ) Notice: Subject to any disclaimer, the term of this patent is extended or adjusted under 35 U.S.C. 154(b) by 185 days.

(21) Appl. No.: 11/510,933

(22) Filed: Aug. 28, 2006

(51) Int. Cl.
*F21V 15/00* (2006.01)

(52) U.S. Cl. ..... 362/367; 362/450; 362/352; 362/360

(58) Field of Classification Search ..... 362/352, 362/355, 357, 360, 361, 367, 450, 433, 346, 362/404, 407, 408, 351, 356, 558, 452, 311; D26/118
See application file for complete search history.

(56) References Cited

U.S. PATENT DOCUMENTS 1,335,640 A * 3/1920 Beales ..... 362/360
1,363,782 A * 12/1920 Handel ..... 362/360
1,759,093 A * 5/1930 Clawson ..... 362/352
2,177,204 A * 10/1939 Buzick et al. ..... 40/554
2,496,482 A * 2/1950 Madan et al. ..... 362/360
2,884,515 A * 4/1959 Fogel ..... 362/352
4,079,245 A * 3/1978 Baker ..... 362/355
4,656,568 A * 4/1987 Reed ..... 362/352
4,688,155 A * 8/1987 Huang ..... 362/352
5,287,259 A * 2/1994 Lautzenheiser ..... 362/341
5,613,770 A * 3/1997 Chin et al. ..... 362/367
6,206,551 B1 * 3/2001 Stubblefield, Jr. ..... 362/360
6,439,746 B2 * 8/2002 Huang ..... 362/352
6,494,601 B2 * 12/2002 Johnson ..... 362/406
6,837,597 B1 * 1/2005 Lin et al. ..... 362/352

* cited by examiner

*Primary Examiner*—Sandra L. O'Shea
*Assistant Examiner*—Gunyoung T. Lee
(74) *Attorney, Agent, or Firm*—Ming Chow; Sinorica, LLC

(57) ABSTRACT

A combination lampshade includes a center hub, a plurality of lampshade elements that are respectively abutted against one another by fastening respective pins into respective pin holes and secured together by swivel hooks at each lampshade element, and an annular retainer fastened to the center hub to secure the lampshade elements around the center hub.

6 Claims, 7 Drawing Sheets

COMBINATION LAMPSHADE

BACKGROUND OF THE INVENTION

1. Field of the Invention

The present invention relates generally to a lampshade and more particularly, to a combination lampshade.

2. Description of the Related Art

Conventionally lighting fixtures are made in different forms for different purposes, such as floor lamps, wall lamps, desk lamps, ceiling lamps, and etc. These lamps may be equipped with a lampshade or without lampshade.

A lampshade is a shade or screen around the lamp to soften the light or to define the projecting direction of the light. Early lampshades are fixed shades, showing a fixed shape. A fixed lampshade is easy to mount and dismount, and not easy to deform. However, a fixed lampshade requires much storage space during delivery. Nowadays, collapsible lampshades, such as bellows type lampshades and spring ring-supported lampshades are commercially available. These collapsible lampshades can be collapsed to save delivery space. However, these conventional collapsible lampshades do not show a unique sense of beauty. Because of poor outer looking, conventional collapsible lampshades give a low-value image, not attractive to most consumers.

SUMMARY OF THE INVENTION

The present invention has been accomplished under the circumstances in view. It is one object of the present invention to provide a combination lampshade, which saves much packing materials and storage space during delivery. It is another object of the present invention to provide a combination lampshade, which is easy to assemble.

According to one aspect of the present invention, the combination lampshade comprises a plurality of lampshade elements. The lampshade elements each comprise an open frame formed of at least three rails and a covering covered on the open frame. The open frame has a plurality of pins and pin holes, and a plurality of swivel hooks. The pins of one lampshade element are respectively fastened to the pin holes of another lampshade element to keep the lampshade elements abutted against one another. The swivel hooks of one lampshade element are respectively hooked on one rail of the open frame of another lampshade element when the lampshade elements are abutted against one another:

According to another aspect of the present invention, the coverings of the lampshade elements can be made out of fabric, plastics, metal, or glass.

According to another aspect of the present invention, the lampshade elements can be shaped like a smoothly arched sector or a semispherical shell. Alternatively, the lampshade elements can be made having a rectangular shape.

According to still another aspect of the present invention, the lampshade elements each have a plug rod extended from one end of the respective open frame. The combination lampshade further comprises a hub. The hub has a plurality of radial coupling troughs, which receive the plug rods of the lampshade elements, and an annular retainer fastened to the hub to secure the plug rods of the lampshade elements to the coupling troughs of the hub.

According to still another aspect of the present invention, the hub has an upright barrel. The upright barrel has a barbed top flange and a plurality of crevices cut through the barbed top flange. The annular retainer is mounted on the hub around the upright barrel, having a stepped center hole forced into engagement with the barbed top flange of the upright barrel.

According to still another aspect of the present invention, the annular retainer has an inner thread extending around the inside wall thereof at a lower part of the stepped center hole.

According to still another aspect of the present invention, the open frames of the lampshade elements each have at least one hanging hole.

DETAILED DESCRIPTION OF THE INVENTION

Figure 1:
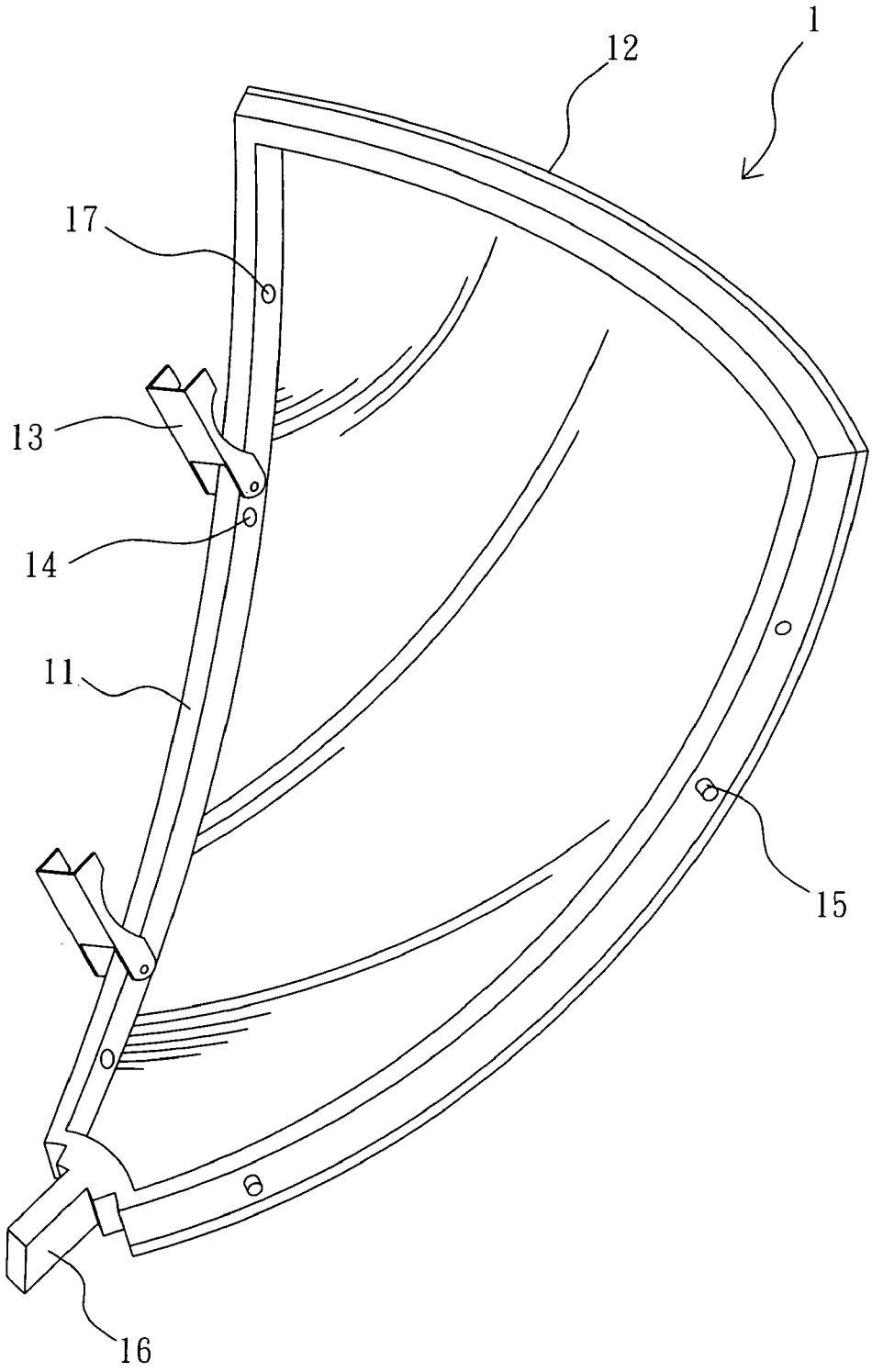
FIG. 1 is an elevational view of a lampshade element for a combination lampshade according to the present invention.
Figure 2:
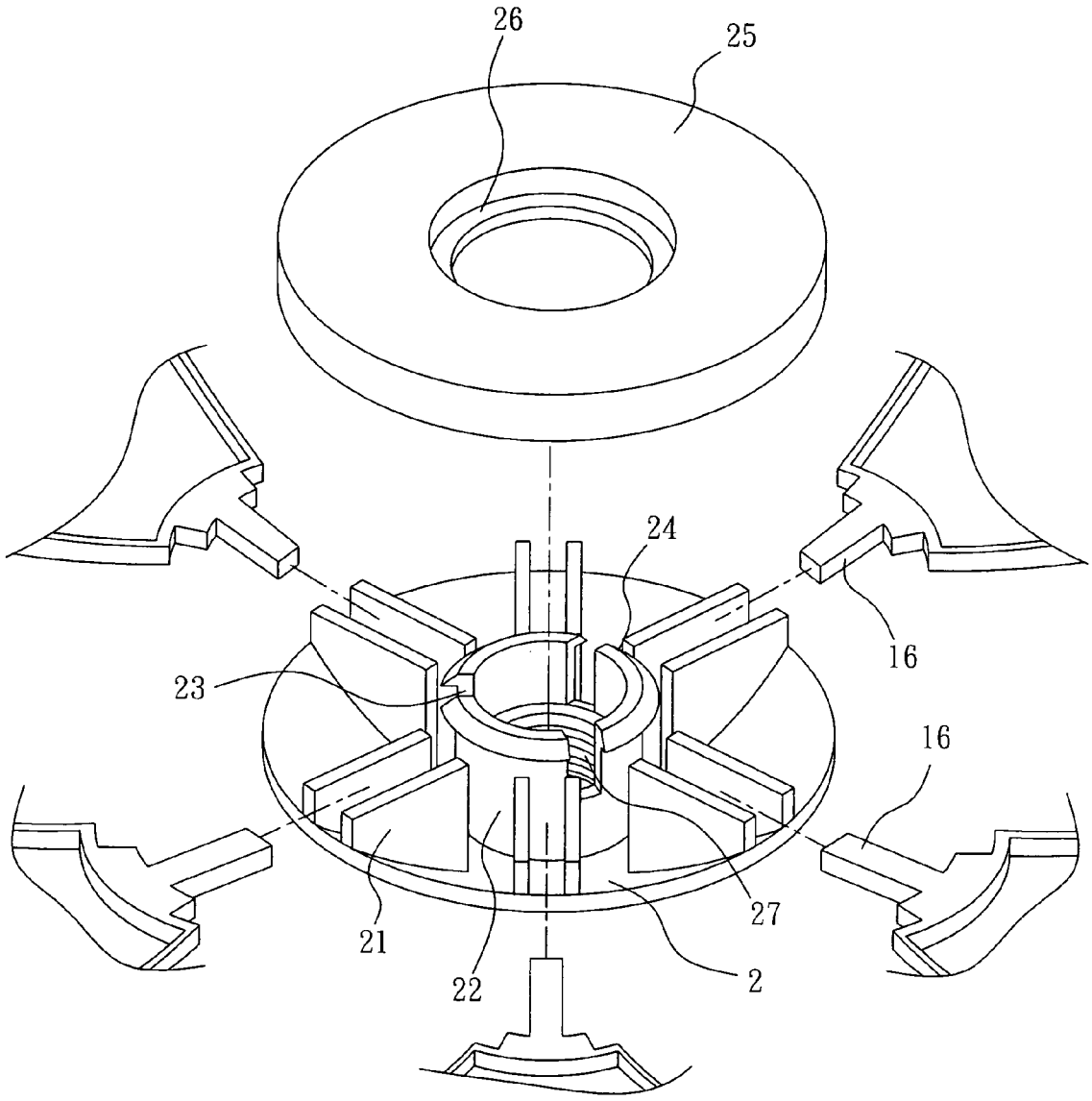
FIG. 2 is an exploded view of a combination lampshade according to the present invention.
Figure 3:
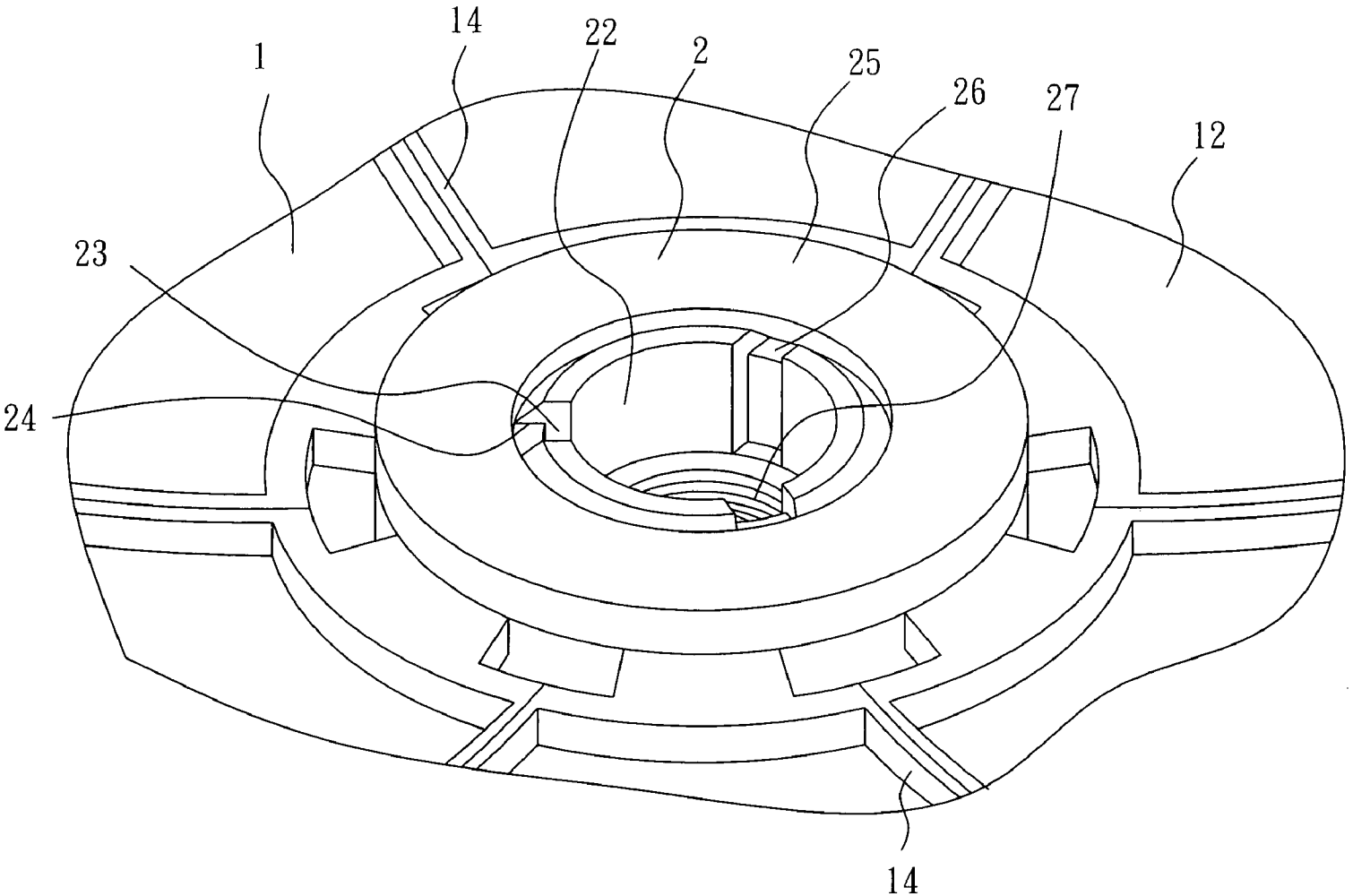
FIG. 3 is an assembly view of the combination lampshade according to the present invention.
Figure 4:
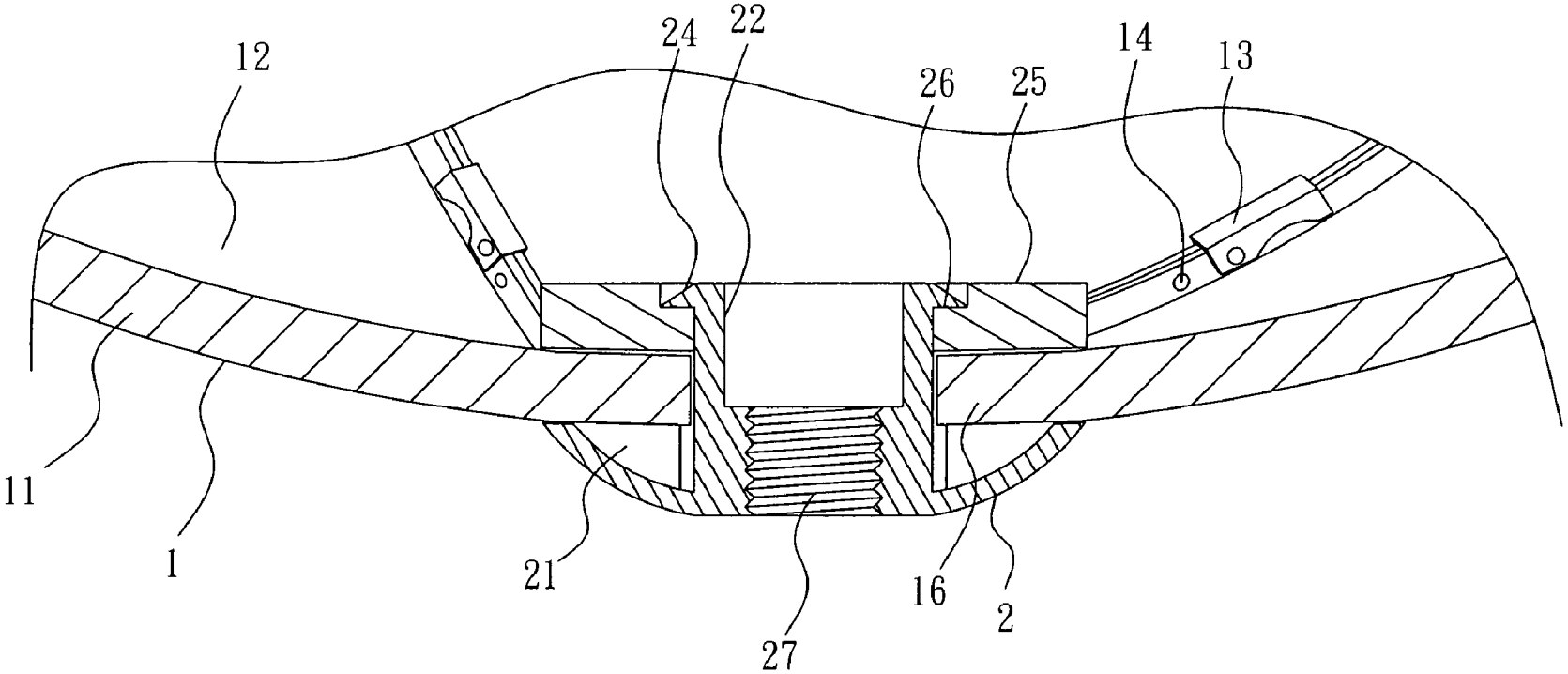
FIG. 4 is a sectional view of FIG. 3.
Figure 5:
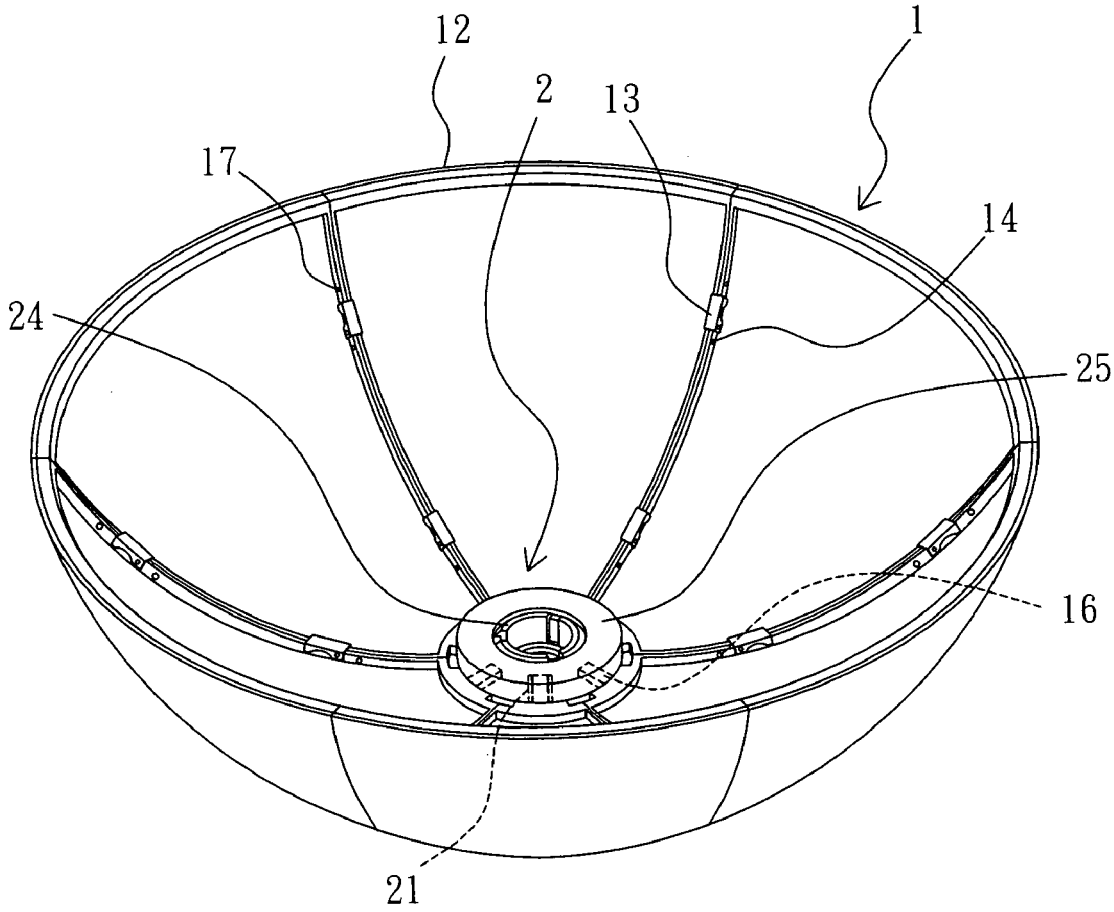
FIG. 5 is an elevational view of the combination lampshade according to the present invention.

Referring to FIG. 1, a lampshade element 1 is shown having a smoothly arched and sector-like open frame formed of three rails 11, and a covering 12 covering the open frame. The covering 12 is a sheet of fabric, plastic, glass, or metal material. According to the preferred embodiment of the present invention, 6 lampshade elements 1 are abutted against one another, forming a semispherical lampshade (see FIG. 5). Alternatively, the lampshade element 1 can be made having a semi-spherical or rectangular shape, or any of a variety of other shapes.

For enabling a number of lampshade elements 1 to be fastened to one another to form a combination lampshade, each lampshade element 1 has pinholes 14 and pins 15 arranged at two opposite lateral sides of the open frame of the rails 11 and swivel hooks 13 at one lateral side of the open frame of the rails 11. By means of fitting the pins 15 of one lampshade element 1 into the pinholes 14 of another lampshade element 1 and then hooking the swivel hooks 13 at one lampshade element 1 to one rail 11 of another lampshade element 1, a number of lampshade elements 1 are fastened together conveniently. Further, the open frame of three rails 11 has hanging holes 17 for hanging.

Referring to FIGS. 2~5 and FIG. 1 again, lampshade elements 1 are abutted against one another and fastened to a circular hub 2 with an annular retainer 25, thereby forming a combination lampshade. According to the preferred embodiment of the present invention, each lampshade element 1 is a 60-degrees sector, having a plug rod 16 extended from one end thereof. The circular hub 2 has an upright barrel 22, and 6 radial coupling troughs 21 equiangularly spaced around the upright barrel 22. The upright barrel 22 has a barbed top flange 24, a plurality of crevices 23 axially cut through the barbed top flange 24 and equiangularly spaced around the periphery, and an inner thread 27 extending around the reduced lower part of the stepped inside wall thereof for mounting. The annular retainer 25 has a stepped center hole 26. After insertion of the plug rods 16 of the 6 lampshade elements 1 into the radial coupling troughs 21 of the circular hub 2, the annular retainer 25 is attached to the upright barrel 22 to force the stepped center hole 26 into engagement with the barbed top flange 24 of the upright barrel 22, and therefore the annular retainer 25 is locked to the circular hub 2 to secure the lampshade elements 1 and the circular hub 2 together.

Figure 6:
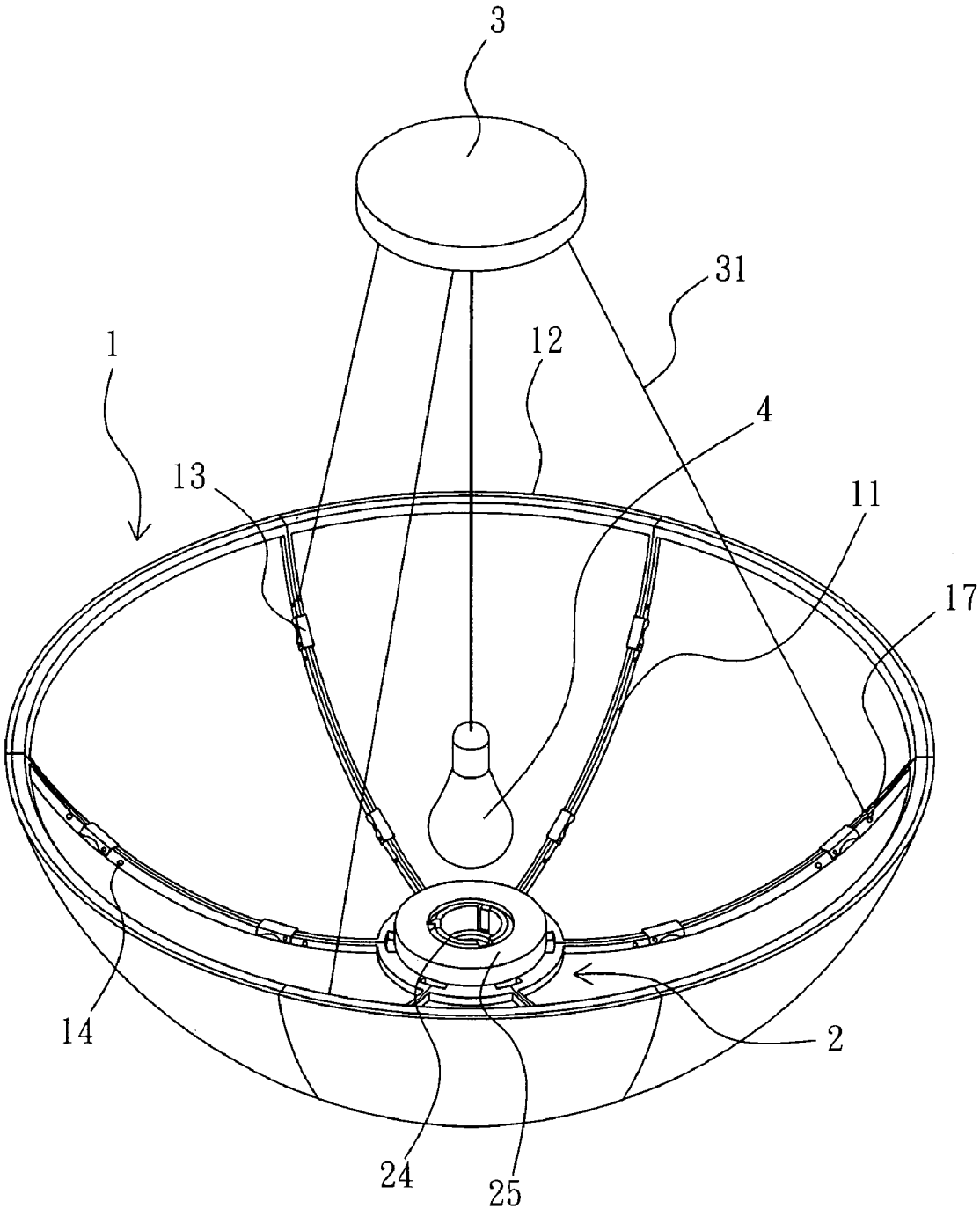
FIG. 6 shows an application example of the present invention.

Referring to FIG. 6, the combination lampshade of the present invention is shown suspended from a ceiling mount 3 by hanging ropes 31, which are fastened to the hanging holes 17 of the lampshade elements 1. Further, a lamp 4 is suspended from the ceiling mount 3 in the holding space within the combination lampshade right above the circular hub 2.

Figure 7:
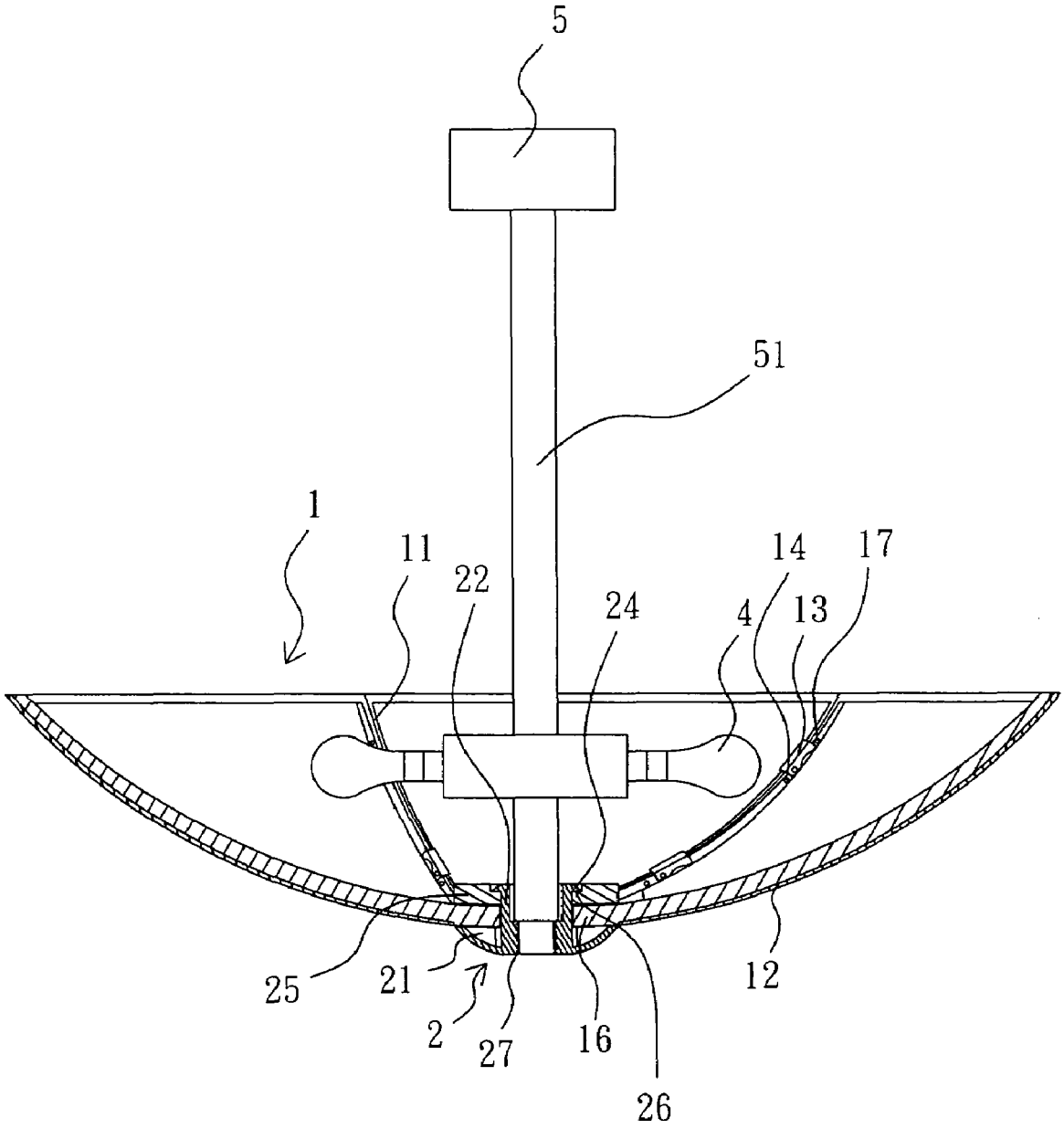
FIG. 7 shows another application example of the present invention.

FIG. 7 shows another application example of the combination lampshade according to the present invention. As illustrated, a tubular axle 51 is vertically connected with the top end thereof to a ceiling mount 6 and the bottom end thereof to the inner thread 27 of the stepped center hole 26 of the upright barrel 22 of the circular hub 2, and lamps 4 are mounted on the tubular axle 51 in the holding space within the combination lampshade.

As indicated above, the present invention provides a combination lampshade, which comprises a circular hub, a plurality of sector-like lampshade elements that are abutted against one another by means of plugging respective pins into respective pin holes and locked together by swivel hooks, and an annular retainer fastened to the circular hub to secure the circular hub and the sector-like lampshade elements together. This design of combination lampshade is easy to assemble, and can be made in any of a variety of shapes for different purposes, for example, for use in a desk lamp, floor lamp, or ceiling lamp. Because of the combination lampshade is built up with small parts, the invention can use small size materials and equipment to fabricate big size lampshades. Further, because the invention allows packing of lampshade parts for delivery, the invention saves much packing material and storage space.

A prototype of combination lampshade has been constructed with the features of FIGS. 1~7. The combination lampshade functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A combination lampshade comprising a plurality of lampshade elements, said lampshade elements each comprising an open frame formed of at least three rails and a covering covered on said open frame, said open frame having a plurality of pins and pin holes and a plurality of swivel hooks, wherein the pins of one lampshade element are respectively fastened to the pin holes of another lampshade element to keep said lampshade elements abutted against one another, and wherein the swivel hooks of one lampshade element are respectively hooked on one rail of the open frame of another lampshade element when said lampshade elements are abutted against one another; and said lampshade elements each have a plug rod extended from one end of the respective open frame, and wherein the combination lampshade further comprises a hub, said hub having a plurality of radial coupling troughs, which receive the plug rods of said lampshade elements, and an annular retainer fastened to said hub to secure the plug rods of said lampshade elements to the coupling troughs of said hub.

2. The combination lampshade as claimed in claim 1, wherein the coverings of said lampshade elements are made out of one of a group of materials including fabric, plastics, metal, or glass.

3. The combination lampshade as claimed in claim 1, wherein said lampshade elements are in shape of a smoothly arched sector, a semispherical shell, or a rectangular shape.

4. The combination lampshade as claimed in claim 1, wherein said hub has an upright barrel, said upright barrel having a barbed top flange and a plurality of crevices cut through said barbed top flange; said annular retainer is mounted on said hub around said upright barrel, having a stepped center hole forced into engagement with the barbed top flange of said upright barrel.

5. The combination lampshade as claimed in claim 4, wherein said upright barrel has an inner thread extending around an inside wall thereof at a lower part of said stepped center hole.

6. The combination lampshade as claimed in claim 1, wherein the open frames of said lampshade elements each have at least one hanging hole.

* * * * *